United States Patent [19]

Wojcik et al.

[11] 3,962,665

[45] June 8, 1976

[54] THERMALLY ACTUATED LIQUID LEVEL SENSOR

[75] Inventors: Edward Wojcik, Queens Village; Ricardo Limeres, Staten Island, both of N.Y.

[73] Assignee: Ideal Corporation, Brooklyn, N.Y.

[22] Filed: Feb. 13, 1975

[21] Appl. No.: 549,546

[52] U.S. Cl. ..... 337/102; 337/107

[51] Int. Cl.[2] ..... H01H 61/02

[58] Field of Search ..... 200/61.04, 290; 337/100, 102, 104, 107

[56] References Cited

UNITED STATES PATENTS

| | | | |
|---|---|---|---|
| 3,171,934 | 3/1965 | Brennan et al. | 337/370 |
| 3,474,372 | 10/1969 | Davenport et al. | 337/100 |
| 3,510,836 | 5/1970 | Summerer | 200/190 X |

*Primary Examiner*—Mark O. Budd
*Assistant Examiner*—Fred E. Bell
*Attorney, Agent, or Firm*—Albert C. Johnston

[57] ABSTRACT

An electro-thermally activated liquid level sensor that functions reliably under widely varying conditions of ambient temperature and supply voltage makes use of an elongate bimetal element cantilevered at one end thereof in a heat conductive wall adapted to be contacted by the liquid and heated by an electrical resistance element, e.g. by a resistance wire wound about the bimetal element and grounded through it, so that the free end of the bimetal element will close cntacts for a signalling circuit when liquid is not contacting said wall and will open the contracts in response to the loss of heat through the fixed end when liquid is contacting said wall. The bimetal element is composed of oppositely oriented bimetal strip segments fixed one to an end of the other and proportioned with the windings of the resistance wire, so that the switching action of the free end is not voltage-dependent; i.e., it will persist in the absence of a heat sink at said wall irrespective of variations of current flow through the resistance element.

10 Claims, 4 Drawing Figures

FIG. 1
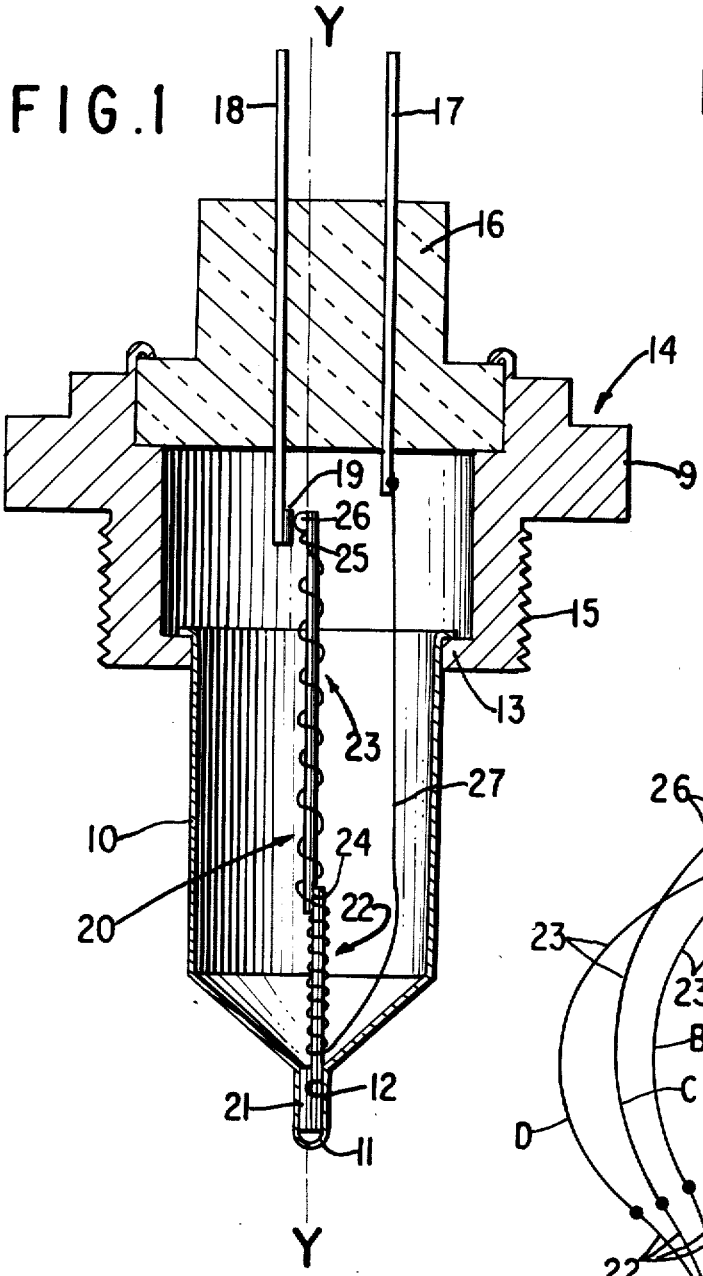
FIG. 2
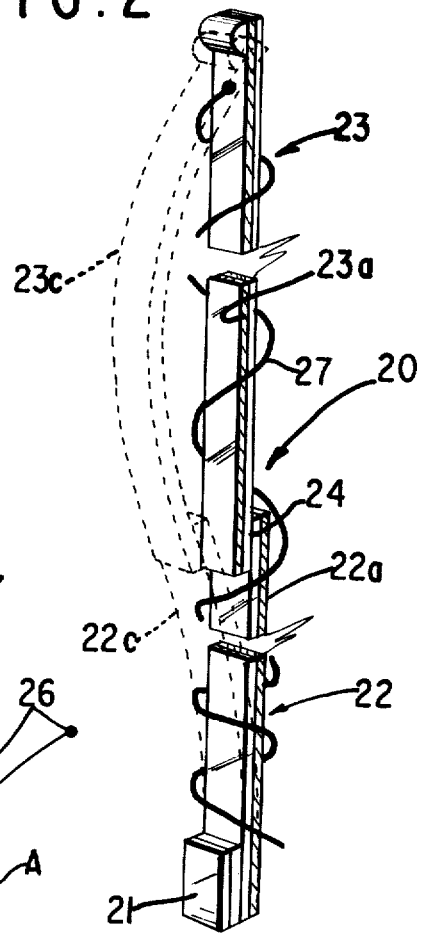
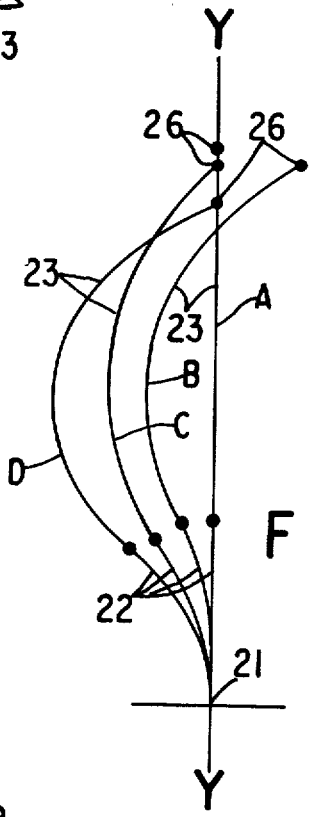
FIG. 4
FIG. 3
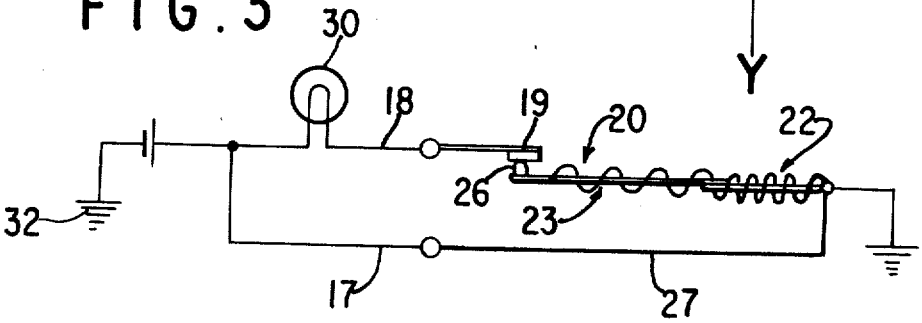

THERMALLY ACTUATED LIQUID LEVEL SENSOR

This invention relates to an electro-thermally activated liquid level sensor that functions reliably under widely varying conditions of ambient temperature and voltage supply. The invention is particularly useful for sensing and signalling the absence in a motor vehicle of a liquid at a required level, e.g., a brake fluid, radiator coolant, engine lubricating oil, or transmission fluid.

Various types of electro-thermally activated liquid level sensors for such uses are known, as illustrated, for instance, in U.S. Pat. Nos. 3,171,934; 3,510,836 and 3,803,525. These known sensors, however, are either objectionably complex or unsuited for reliable operation under the widely variable conditions of ambient temperature and supply voltage which may be encountered in their use as liquid level sensing or warning devices in motor vehicles. In order to serve reliably for such uses, a liquid level sensor should detect and signal the absence of liquid at a required level under any ambient temperature condition that may exist in the use of a motor vehicle, i.e., in the range of approximately −40° to 300°F., and should do this irrespective of normal variations of the voltage of the power supply of the vehicle. Such variations typically may occur over the range from approximately 9 V to 16 V, with a consequent three-fold variation of the power flow through a sensor of constant resistance.

The principal object of the present invention is to provide a liquid level sensor that will operate reliably under the widely varying conditions of voltage and ambient temperature that may be encountered in the use of the sensor for detecting the loss of a required liquid level in motor vehicles.

Another object of the invention is to provide a liquid level sensor that is activated thermally by an electrical resistance means yet operates with minimal power consumption and with good sensitivity under varying voltage conditions.

A further object is to provide a liquid level sensor that is simple in construction and thus has low production costs.

In accordance with this invention, a heat-conductive wall that will be contacted on one side thereof by a liquid to be sensed when the liquid is at a required level, as in a brake fluid, coolant, or oil reservoir of a motor vehicle, has an end of an elongate bimetal element fixed to the other side thereof in thermally conductive relation thereto, and the bimetal element protrudes from said wall in cantilevered relation thereto to a free end of said element which is disposed away from said wall and by which electrical contact means are operable to open or close a signalling circuit. The bimetal element is formed of segments of bimetal strip material joined together in opposite orientation, and it has an electrical resistance means disposed along it and connectable with a source of electrical current for heating it so that, while it is being heated by the resistance means, the bimetal element will have one or the other of two distinct postures, corresponding to different circuit regulating positions of its free end, depending upon whether or not heat is being lost through its fixed end as to a body of liquid contacting the heat-conductive wall. The bimetal element is so formed and the resistance heating means so disposed along it that at any voltage of the current supply to be expected in the use of the sensor, such as in the 9 to 16 V range of a motor vehicle storage battery, the bimetal element will have a posture in which it holds its free end on substantially the same, definite line relative to its fixed end. It thus will maintain the same circuit condition at any such voltage, or under any ambient temperature to be expected in a motor vehicle, until its posture is changed so as to displace its free end laterally in response to a pronounced loss of heat through its fixed end, as to a body of liquid contacting the heat-conductive wall.

The bimetal element advantageously is composed of two normally straight lengths of similar bimetal strip material having respective ends thereof joined together and having their respective similar metal layers oppositely oriented by facing in opposite directions. The bimetal element so formed protrudes substantially straight from the heat-conductive wall while in its normal, or cold, condition. Upon being heated by the resistance element, the joined segments bow in opposite directions; yet when and as long as the segments are heated substantially uniformly, even though at temperatures varying with the supply current voltage, or with the ambient atmospheric temperature, they will hold the free end of the element substantially on the same straight line relative to its fixed end. On the other end, when the segment having its end fixed to the heat-conductive wall is losing heat as to liquid in contact with that wall, this segment is heated and bowed to a lesser extent than the other, or outer, segment, so that the bimetal element then has a posture in which its free end is disposed laterally away from the said line to a circuit opening position, or possibly a circuit closing position.

The resistance heating means advantageously is an electrical resistance wire wound about and electrically insulated from a major part of the length of the bimetal element, one end of this wire being connected with a terminal for connection with the current source and its other end connected to the bimetal element near an end thereof, preferably near its free end. Current for heating the windings of the wire and the bimetal element inside them thus will flow from the current source through the terminal, the resistance wire and the bimetal element, as the bimetal element is conductive and is fixed to a heat-conductive wall which also is electrically conductive and will provide a path to ground when the sensor is installed for use.

The heat-conductive wall constitutes a probe, or part of a sensor housing, adapted to be installed in an opening in a reservoir wall connected with the grounded frame of a motor vehicle. It may have the form of a cup extending from an electrically conductive collar that fits about it and is threaded so as to be screwed into the opening in the reservoir wall. A central probe portion of the wall protrudes outwardly from it for engagement by liquid in the reservoir and forms a recess at its inner side, in which recess one end of the bimetal element is fixed in place, for example by being welded therein.

The foregoing and other objects, features and advantages of the invention will be further apparent from the following detailed description and the accompanying drawings of an illustrative embodiment thereof. In the drawings:

FIG. 1 is a cross-sectional view of an illustrative embodiment of the liquid level sensor;

FIG. 2 is an enlargement showing details of the bimetal element of FIG. 1;

FIG. 3 is a diagram of a circuit utilizing the sensor, and

FIG. 4 is a diagram schematically illustrating positions of the bimetal element of FIG. 1 under various operating conditions.

The liquid level sensor as illustrated in FIG. 1 comprises a probe housing defined in part by a cup-shaped wall, or shell, 10 composed of an electrically and thermally conductive material resistant to elevated temperatures, such as stainless steel tube No. 302 with a wall thickness of 0.005 in. and 0.930 in. long with a diameter of 0.266 in. The wall 10 has a probe portion 11 protruding outwardly from a central forward portion thereof and forming a recess 12 at its inner side. The backward end of the cup-shaped wall 10 is fixed and sealed in a surrounding annular flange 13 of a collar member 14, also composed of electrically conductive material, which is formed with external screw threads 15 to enable the sensor to be screwed into a threaded opening of a reservoir wall, e.g., a brake fluid master cylinder of a motor vehicle, wherein the presence or absence of a body of liquid at a required level is to be detected. The collar member 14 is closed at its outer end by an end plug or closure 16 of electrically insulating material, and two electrical terminals 17 and 18 extend through this insulating closure member for connection in an electrical circuit, for example, as shown in FIG. 3. For instance, terminal 17 is connectible directly with a current source such as a motor vehicle storage battery and terminal 18, which extends to a relatively fixed electrical contact 19 inside the probe housing, is connectible to a signalling device such as a pilot lamp 30.

An elongate bimetal element, generally indicated at 20, is fixed in thermally conductive relation to the heat-conductive wall 10, such as by spot welding of an end portion 21 of element 20 in recess 12. Bimetal element 20 is composed of two substantially straight segments 22 and 23 of the same bimetal strip material, which are oppositely oriented and have overlapping end portions at 24 joined together as by welding. Element 20 thus protrudes into the space of the probe housing in cantilevered relation to the probe portion 11 of wall 10, extending from the fixed end portion 21 to an inner, free end portion 25 of the bimetal element. The free end is disposed away from the heat-conductive wall, and it carries a movable electrical contact 26 that engages with and disengages from the fixed contact 19 under conditions to be described below. Among the various bimetal strip materials suitable for making element 20 is the material sold under the trade mark MAGNAFLEX by the H. A. Wilson Company. Strips of that material having transverse dimensions of 0.150 in. by 0.010 in. will form a satisfactory element when used, for example, in a length of 0.270 inch for the portion of segment 22 between the joint at 24 and the fixed end portion 21 and a length of 0.800 inch for the portion of segment 23 beyond the joint 24.

Heat is supplied to the bimetal element 20 by means of an insulated electrical resistance wire 27 that leads from terminal 17 to the base of the bimetal element and is wound upwardly about the segments 22 and 23 to a location near the free end 25, where the wire end is connected directly to element 20. Element 20 and the electrically conductive wall 10 and collar 14 of the probe housing provide a path for current to flow through wire 27 to ground when the sensor is installed for use, such as in an opening at the desired liquid level of a brake line master cylinder connected electrically with the grounded frame of a motor vehicle.

The electrical resistance wire 27 preferably is made of an alloy whose resistance increases, so its conductance decreases, with increases of its temperature or energy input. For example, such a wire is sold under the trade mark BALCO by Wilber B. Driver Company. This enables the resistance wire to be operated with a smaller average power consumption than that of ordinary resistance wire, yet to maintain good sensitivity of performance over the voltage range to which the wire may be subjected in the use of the sensor. The wire may have, for instance, a diameter of about 0.0015 inch and may be insulated, for example, with double windings of fiber glass-nylon filaments—a wire of approximately 8 inch in length and wound eight turns of uniform pitch about bimetal segment 23 and nine turns of uniform pitch about bimetal segment 22 was found to be satisfactory.

As is well known, bimetal strips will bend or bow in response to changes in temperature, due to the different coefficients of thermal expansion of the component layers of dissimilar metals. The segments 22 and 23 of the bimetal strip material constituting element 20 are oriented oppositely so that they will bow in opposite directions upon being heated by the wire 27. As indicated in FIG. 2, the respective metal layers of these segments that have the same coefficient of thermal expansion face in opposite directions. Layer 22*a* of segment 22 and layer 23*a* of segment 23 are composed of the metal having the greater coefficient of thermal expansion. Upon heating of the bimetal segments by the resistance wire 27, the bimetal segment 22 will bow to the left as shown in dotted lines 22*c* of FIG. 2, and bimetal segment 23 will bow to the right as shown in dotted line 23*c*. The degree of curvature of each bimetal segment varies with the temperature produced in it by the heating.

To provide for a device operable over the entire range of ambient temperatures and supply voltage fluctuations to be expected in its use in a motor vehicle, the lengths of the free portions of bimetal segments 22 and 23 and the windings of the resistance wire 27 are so related that at any temperature to be produced in the bimetal element by the resistance wire 27, absent heat loss from the sensing portion 22 of the bimetal element as to a body of liquid contacting the probe portion 11 of wall 10, the free end 25 of the bimetal element, and thus the movable contact 26 fixed on that end, is maintained substantially on a definite line from said movable contact to the end portion 21 of the bimetal element fixed in recess 12, i.e., on a line such as that indicated at Y—Y in FIGS. 1 and 4. The movable contact thus can be kept in engagement with the fixed contact 18 notwithstanding variations of its distance from the fixed end 21. In order to assure good electrical contact in all the circuit closing conditions, the contact 19 is semicylindrical in the direction of the length of the bimetal and contact 26 is semicylindrical and transverse to contact 19, as seen in FIG. 1.

Typical postures of the bimetal element 20 under different conditions of operation of the liquid level sensor are indicated diagrammatically in FIG. 4. Lines A, C and D represent positions assumed by the bimetal element at different heating temperatures when there is no body of liquid engaging the probe portion 11. In these positions, which correspond to the circuit closing posture of the bimetal element 20, the sensing segment 22 bows to the left as viewed in FIG. 4, while the upper or compensating segment 23 bows compensatingly to the right so as to maintain contact 26 on line Y—Y and thus in engagement with the fixed contact 19. As indicated in FIG. 3, current from the battery 32 then will flow through the pilot lamp 30 and via terminal 18, contacts 19 and 26, bimetal element 20, wall 10 and collar 14 to the ground, activating the signal lamp circuit. Line B represents the posture of the bimetal element when a body of liquid is contacting the probe portion 11, in which condition the body of liquid serves as a heat sink drawing heat from the sensing segement 22 of the bimetal element and decreasing its temperature without correspondingly decreasing the temperature of the upper or compensating bimetal segment 23. As a result of this heat loss, the bowing of bimetal segment 22 is decreased, causing the free end 25 of the bimetal element and the movable contact 26 thereon to be displaced laterally away from the line Y—Y to a posture in which the contacts are disengaged, for opening the signal circuit.

Thus, notwithstanding fluctuations of the voltage supply or of the ambient atmospheric temperature about the sensor, the movable contact will be displaced away from the fixed contact whenever a body of liquid is present about the probe portion, and will be held in a circuit closing posture substantially on line Y—Y whenever the liquid level falls below the probe portion, due to the selected lengths of bimetal segments and windings of resistance wire 27.

An alternative embodiment accomplishing similar operational characteristics may be achieved by providing bimetal segments of equal length. The thicknesses of these segments and the windings of the resistance wire are so related that the free end of the bimetal element and the movable contact fixed on that end will remain on the above line. This construction provides a bimetal assembly with improved response when subject to severe voltage changes.

While the principles of the invention have been described with reference to illustrative embodiments thereof, it will be understood by those skilled in the art that various modifications and alterations of these embodiments may be made without departing from the scope or spirit of the invention, which is intended to be defined by the appended claims.

We claim:

1. A liquid level sensor comprising a heat-conductive wall adapted to be contacted by a body of liquid, an elongate bimetal element protruding from said wall, said element having one end thereof fixed in thermally conductive relation to said wall and having its other end disposed away from said wall, contact means operable by said other end to open or close a signalling circuit, and electrical resistance means disposed along said bimetal element and connectible with a source of electrical current for heating said element, said bimetal element while being heated by said resistance means having either of two distinct postures in which, respectively, its said other end holds said contact means in either circuit opening or circuit closing position, said bimetal element and said heating means constituting means operative at any voltage of said current, absent heat loss from said element as to a body of liquid contacting said wall, to hold said other end substantially on the same line relative to said fixed end so as to maintain one of said postures, and operative during such heat loss to displace said other end laterally into the other of said postures.

2. A sensor according to claim 1, said wall comprising a probe portion protruding outwardly and forming a recess at its inner side, said one end of said bimetal element being fixed in said recess.

3. A sensor according to claim 1, said bimetal element comprising a first segment of bimetal strip material extending from said fixed end and a second segment of bimetal strip material joined to and extending from the free end of said first segment, said second segment being oriented oppositely and proportioned in length relative to said first segment so that said other end will hold said contact means substantially on said line when in said one posture.

4. A sensor according to claim 1, said bimetal element comprising a first segment of bimetal strip material extending from said fixed end and a second segment of bimetal strip material joined to and extending from the free end of said first segment, said second segment being oriented oppositely and proportioned in thickness relative to said first segment so that said other end will hold said contact means substantially on said line when in said one posture.

5. A sensor according to claim 1, said heating means comprising an electrical resistance wire wound about and electrically insulated from a major part of the length of said bimetal element, one end of said wire being electrically connected with a terminal for connection with said current source and the other end of said wire being connected to said element near an end thereof, said element and said wall upon grounding of said wall providing a path to ground for current passed through said wire.

6. A sensor as in claim 4, said electrical resistance wire being composed of a material whose resistance increases with increases of temperature.

7. A sensor according to claim 1, said bimetal element comprising a first segment of bimetal strip material extending from said fixed end and a second segment of bimetal strip material joined to and extending from an end of said first segment, each of said segments normally being substantially straight, the respective metals of said segments being oppositely oriented so that said segments will bow in opposite directions upon being heated, said heating means comprising an electrical resistance wire wound about both of said segments, the respective lengths of said segments and the respective windings of said wire about them being so proportioned that, absent heat loss from said element as to a body of liquid contacting said wall, said wire heat said segments to a substantially uniform temperature and thereby maintain said other end on said line at any voltage of the current from said source.

8. A sensor according to claim 1, said contact means comprising a relatively fixed contact electrically connected with a first terminal connectible in said signalling circuit and a movable contact fixed to said other end of said bimetal element, said heating means comprising an electrical resistance wire wound about and electrically insulated from a major part of the length of said bimetal element, one end of said wire being electrically connected with a terminal for connection with said current source and the other end of said wire being connected to said element near its said other end, said element and said wall upon grounding of said wall providing a path to ground for current passed through said wire, said element in its circuit closing posture also providing a path through said contacts from said first terminal to ground.

9. A sensor according to claim 6, said contact means comprising a relatively fixed contact and a movable contact on said other end of said bimetal element, one of said contacts being elongated in the direction of said line.

10. A liquid level sensor comprising a heat-conductive wall having a probe portion thereof protruding outwardly therefrom to be contacted by a body of liquid and forming a recess on its inner side, an elongate bimetal element having one end thereof fixed in said recess in thermally conductive relation to said probe portion and having its other end disposed away from said wall, said bimetal element comprising a first substantially straight segment of bimetal strip material extending from said fixed end and a second substantially straight segment of said material joined to an end of said first segment and extending therefrom to said other end, the respective metals of said segments being oppositely oriented so that said segments will bow in opposite directions when heated, a movable contact fixed to said other end of said element, a relatively fixed contact engageable by said movable contact and connected with a terminal connectible with a signalling circuit, an electrical resistance wire wound about and electrically insulated from a major part of the length of said bimetal element, one end of said wire being connected with a terminal for connection with a source of current and the other end of said wire being connected to said element near said other end of said element, said element and said wall upon grounding of said wall providing a path to ground for current passed through said wire, the respective lengths of said segments and the respective windings of said wire about them being such that at any voltage of said current, absent heat loss from said element as to a body of liquid contacting said probe portion, said other end of said element will be held in a posture closing said contacts, yet during such heat loss said element will deform to hold said movable contact away from said fixed contact.

* * * * *